US006357184B1

(12) United States Patent
Alley

(10) Patent No.: US 6,357,184 B1
(45) Date of Patent: Mar. 19, 2002

(54) SNOW GUARD SYSTEM HAVING A FLAG TYPE ATTACHMENT

(76) Inventor: F. William Alley, Gebbie Rd., Greensboro, VT (US) 05841

( * ) Notice: Subject to any disclaimer, the term of this patent is extended or adjusted under 35 U.S.C. 154(b) by 0 days.

(21) Appl. No.: 09/280,635

(22) Filed: Mar. 29, 1999

(51) Int. Cl.[7] ..... E04D 13/10

(52) U.S. Cl. ..... 52/25; 52/24; 52/667; 52/732.01; 52/730.4; 256/56; 256/12.5; 256/13; 256/DIG. 2; 211/182

(58) Field of Search ..... 52/24, 25, 667, 52/732.01, 730.4; 256/65, 12.5, 13, DIG. 2; 211/182

(56) References Cited

U.S. PATENT DOCUMENTS

| | | | | | |
|---|---|---|---|---|---|
| 42,992 | A | | 5/1864 | Howe | |
| 473,512 | A | | 4/1892 | Laird | |
| 745,570 | A | * | 12/1903 | Clarke | 52/732.1 |
| 756,884 | A | | 4/1904 | Parry | |
| 1,790,798 | A | * | 2/1931 | Davis | 211/182 |
| 1,925,263 | A | | 9/1933 | Levow | |
| 3,182,762 | A | | 5/1965 | Syak et al. | |
| 5,228,248 | A | | 7/1993 | Haddock | |
| 5,609,326 | A | * | 3/1997 | Stearns | 52/25 |
| 5,613,328 | A | * | 3/1997 | Alley | 52/24 |
| 5,983,588 | A | * | 11/1999 | Haddack | 52/25 |
| 6,017,019 | A | * | 1/2000 | Erwin | 256/654 |

FOREIGN PATENT DOCUMENTS

| | | |
|---|---|---|
| DE | CH 671063 A5 | 7/1989 |
| GB | 666147 | 2/1952 |

* cited by examiner

*Primary Examiner*—Carl D. Friedman
*Assistant Examiner*—Dennis L. Dorsey
(74) *Attorney, Agent, or Firm*—Burr & Brown

(57) ABSTRACT

A device capable of being attached to a roof as part of a snowguard system to prevent snow or ice from falling off the roof. The snowguard system includes a plurality of mounting brackets each having a bracket portion with at least one bore defining at least one cutout region therethrough. This cutout region has a first circumferential shape. At least one pipe is slidably inserted through one of the bores in each of the bracket portions. Each pipe has a circumferential shape substantially similar to that of each cutout region to thereby prevent rotation of the pipe with respect to the bracket. At least one flag is provided for attachment to the pipe. Each flag has an interior which is substantially geometrically similar to at least a portion of the circumferential shape of the pipe, thereby allowing the interior portion of the flag to lockingly engage the exterior of one of the pipes such that the flag does not rotate with respect to the pipe to which it is attached.

54 Claims, 11 Drawing Sheets

SNOW GUARD SYSTEM HAVING A FLAG TYPE ATTACHMENT

BACKGROUND OF THE INVENTION

1. Field of the Invention

The present invention relates generally to a snow guard system capable of being attached to a roof, which is used to prevent snow from sliding off the roof, and more particularly to an improved flag for attachment to a pipe employed in such snow guard systems to better restrain snow from sliding off the roof.

2. Related Art

Sliding snow and/or ice from roofs can be hazardous to people, the surrounding landscape, property, and building components. The problem of sliding snow or ice is particularly prevalent in connection with metal roofs, including raised seam roofs, where there is relatively little friction between the roof and the snow or ice. To combat this problem, guards have been developed for controlling movement of snow and ice across selected areas of roofs by preventing sliding of snow and ice down the pitch of the roof.

These snowguard systems have long been used to control the movement of snow and ice located on roofs, for example, see U.S. Pat. No. 42,972 to Howe, which issued May 31, 1864. Recently, these snow guard systems have increased in popularity, and currently several snowguard mounting systems serve to hold snowloads on roofs.

FIG. 1 shows an example of one such snow guard system, as described in detail in applicant's U.S. Pat. No. 5,613,328, the entirety of which is incorporated herein by reference. As shown in FIG. 1, the snow guard comprises blocks 100, each having a groove, or other suitable opening, located in the base thereof. The blocks are attached to the metal roof by placing the groove about a segment of the seams in the metal roof. Each block further has a groove, or other suitable opening, located in the top thereof, for holding brackets 101. The brackets have a plurality of holes located therein, allowing round pipes 102 to be placed therethrough. The pipes help to secure snow which might accumulate on the roof, thereby preventing it from falling off the roof and potentially injuring persons or damaging property located in its fall path.

In an effort to further improve the snow restraining capabilities of the above mentioned snow guard, artisans have previously affixed a one-piece curled vertical flag 103 to the horizontal pipes, as shown in FIG. 2. The specific shape of flag 103 is shown in FIGS. 3A, 3B, and 3C. The upper portion of flag 103 rests on the upper horizonal pipe, and is prevented from rotating in the direction of the snow load by the lower second horizontal pipe. These vertical flags allow the snow load to be restrained more effectively compared to the use of horizontal piping alone. Moreover, since the bottom of the flags is spaced from the roof, they still allow a portion of the snow load to fall from the roof, to thereby prevent the snow from accumulating to dangerous levels.

However, there are a number of drawbacks generally associated with the snow guards described above. One particular drawback relates to the flags, in that they usually are not securely attached to the pipes. As a result, the flags can fall off when caused to rotate by some external disturbance. In particular, the flags can be blown off of the pipes when there is no snow load, by wind gusts traveling in directions opposite to the snow load, (i.e., from the eaves to the peak of the roof).

Additional securing means 104 are sometimes provided to hold the flags on the pipes. However, the securing means do not entirely prevent rotation of the flags when subjected to a disturbance. As a result, the flags can still rotate around the circular pipe, so that the bottom of the flag rests on the downstream side of the lower pipe. Thereafter, the flag cannot perform its intended function (i.e., the lower pipe no longer stands behind the bottom portion of the flag to restrain the snow load).

Another problem with flags that use securing means is that they are more expensive to manufacture and more difficult to install. Specifically, the securing means is an additional component that takes more time to make and more time to install on the roof. Due to the height of roofs that typically require snow guard systems, the installation crew would like to minimize the amount of time and effort they spend while on the roof itself. The current snow guard systems, however, do not allow fast and easy installation.

SUMMARY OF THE INVENTION

It is an object of the present invention to overcome the above-discussed drawbacks associated with prior art snow guard systems.

To carry out the objects described above, one embodiment of the present invention is directed to a device for use as a component part of a snowguard system for preventing materials from sliding off a roof. The device comprises a mounting bracket having a bracket portion with at least one bore defining at least one cutout region therethrough. The cutout region has a circumferential shape. At least one pipe is slidably insertable through the bore and has a circumferential shape substantially similar to that of the cutout region. Interaction between the two shapes prevents rotation of the pipe relative to the bracket. The device also includes at least one flag having an interior portion whose shape is substantially geometrically similar to at least a portion of the circumferential shape of the pipe, thereby allowing the interior portion of the flag to lockingly engage the exterior of the pipe, without being able to rotate with respect to the pipe (and bracket).

Preferably, the circumferential shape of the pipe is non-circular to prevent rotation of the flag relative to the pipe and, in turn, to prevent rotation of the pipe relative to the bracket. For instance, a D-shaped cross-section, a polygonal shaped cross-section, an elliptical shaped cross-section, a parabolic shaped cross-section, or a truncated cone shaped cross-section could be used for the pipe and cut-out region of the bracket.

The flag can have any shape which allows for attachment to the pipe. The most important thing is that the flag is self-locking on the pipe without any additional attachment mechanism (although one could be used in an overabundance of caution). In a preferred embodiment the flag has an inverted, vertical J-shape.

The bore and the pipe should be oriented such that an axis of symmetry of the pipe is substantially perpendicular to the direction of the force exerted by a load thereon. This allows the pipe to withstand maximum tensile and compressive stresses caused by the load.

The pipe may optionally include at least one diametrical reinforcement member on its interior. This reinforcement member should be oriented to provide maximum resistance to the load exerted thereon. In a preferred embodiment, the diametrical reinforcement member is web-like in cross-section.

In addition, the mounting bracket can be one piece or comprised of separate pieces. For example, the mounting bracket can comprise a mounting block and a bracket portion, in which the mounting block has a first groove in the upper surface thereof for slidably receiving the bracket portion, and in which the mounting block has a second groove in the lower surface thereof for attachment to the seam of a metal roof.

Additional objects, advantages, and other novel features of the invention will become apparent to those skilled in the art upon examination of the detailed description and drawings that follow.

DETAILED DESCRIPTION OF THE INVENTION

In order that the present invention may be more readily understood, the following description is given, merely by way of example, reference being made to the accompanying drawings.

Figure 6B:
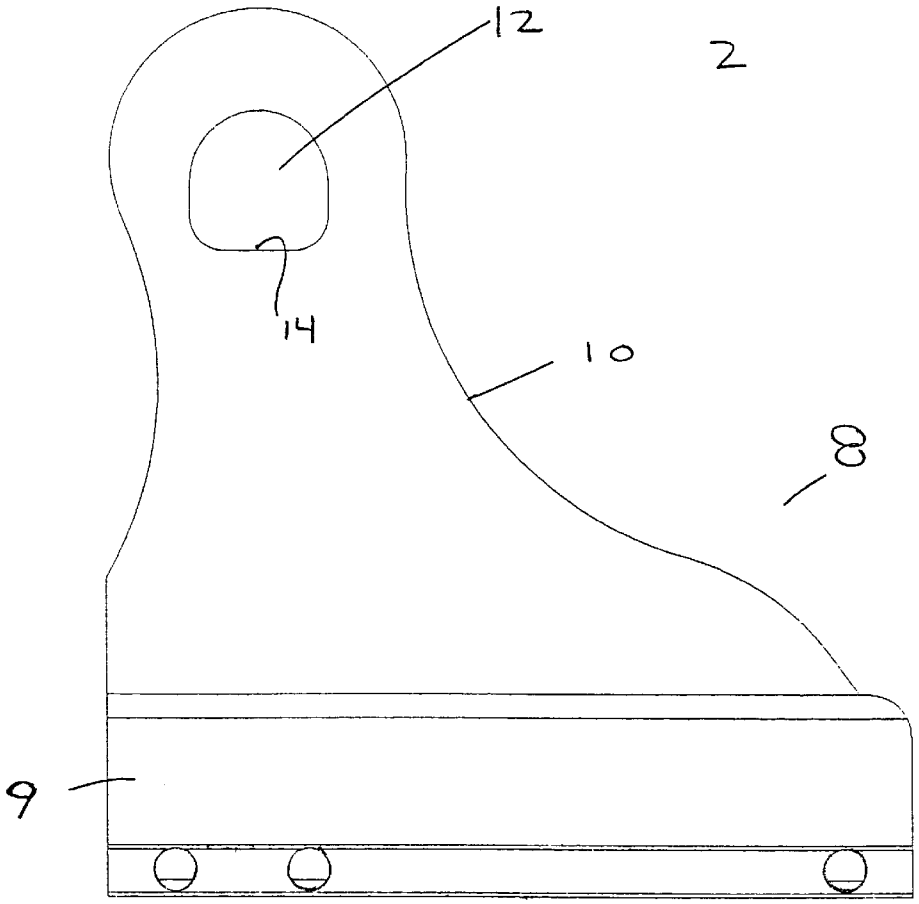
FIGS. 6A and 6B show a perspective view and a lateral plan view of one of a bracket portion with only one cutout region.
Figure 6A:
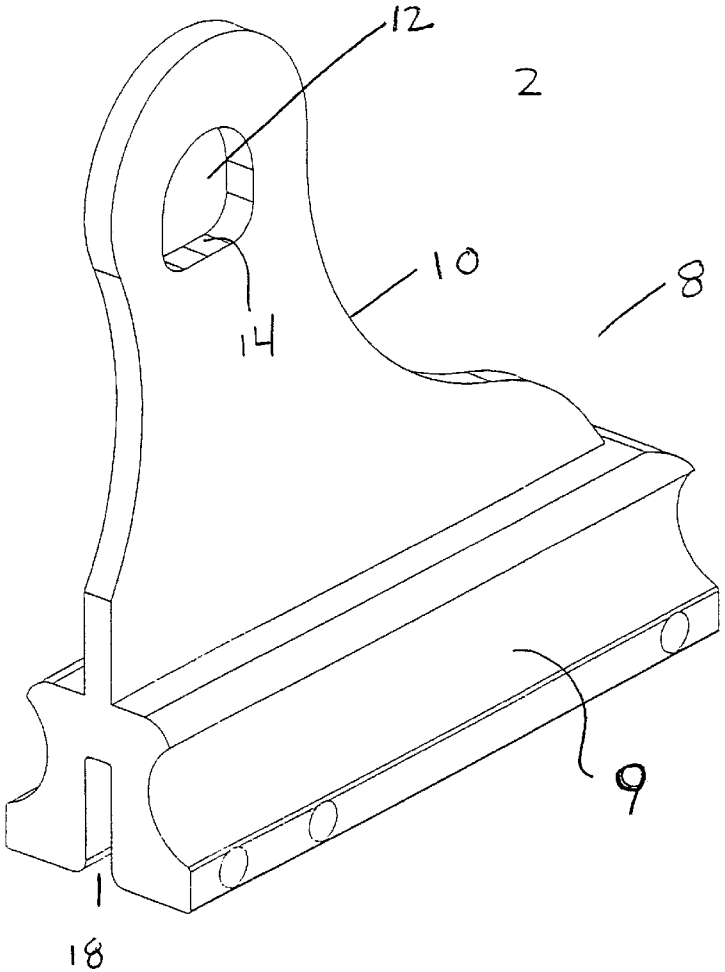
Figure 7B:
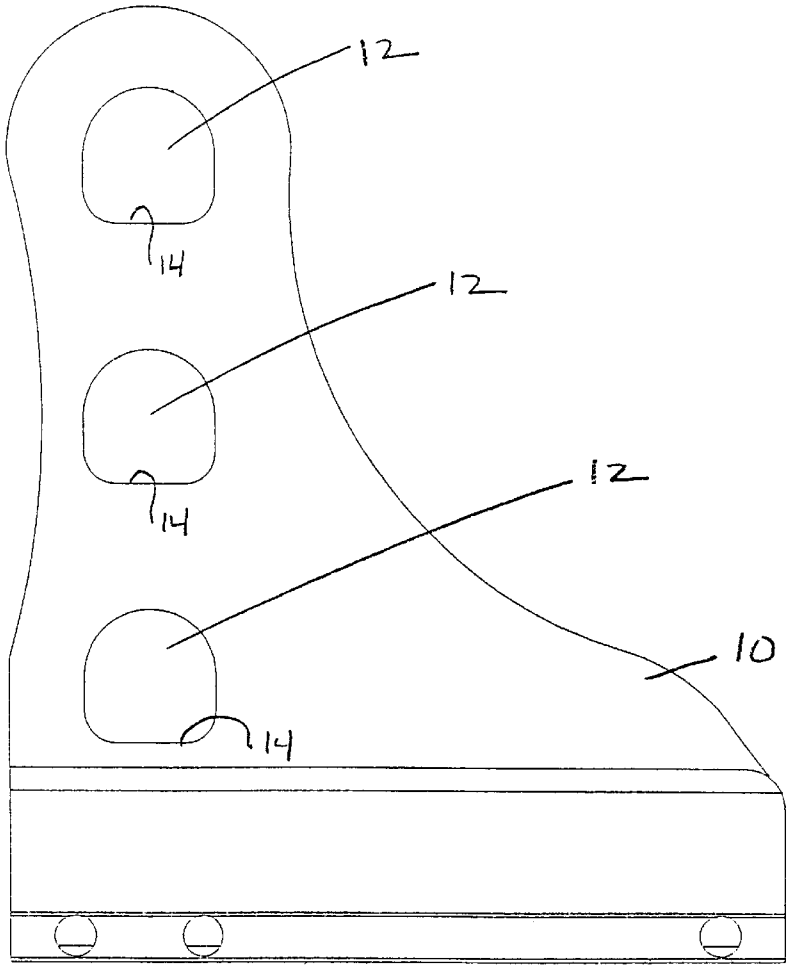
FIGS. 7A and 7B show a perspective view and a lateral plan view of another embodiment of a bracket portion having a plurality of cutout regions.
Figure 7A:
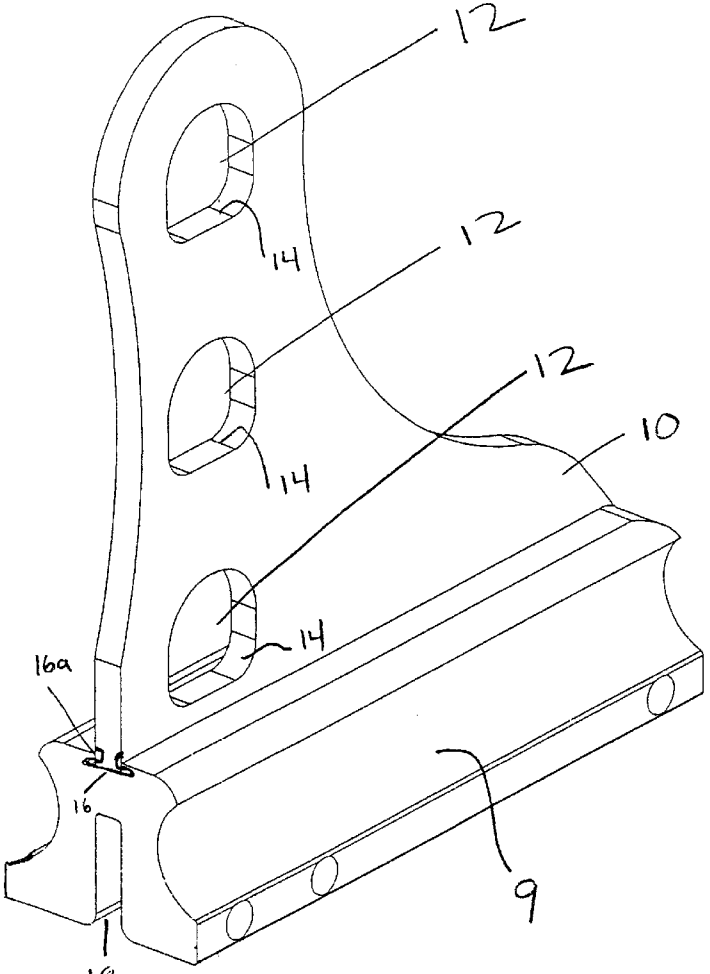
Figures 8A, 8B, 8C, 8D, 8E:
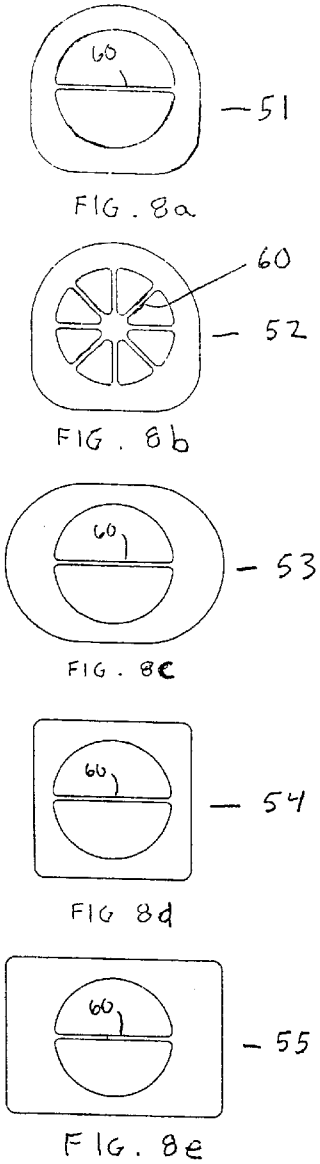
FIGS. 8A–8I show other possible pipe cross-sections, each with a diametrical web in place.
Figures 8F, 8G, 8H, 8I:
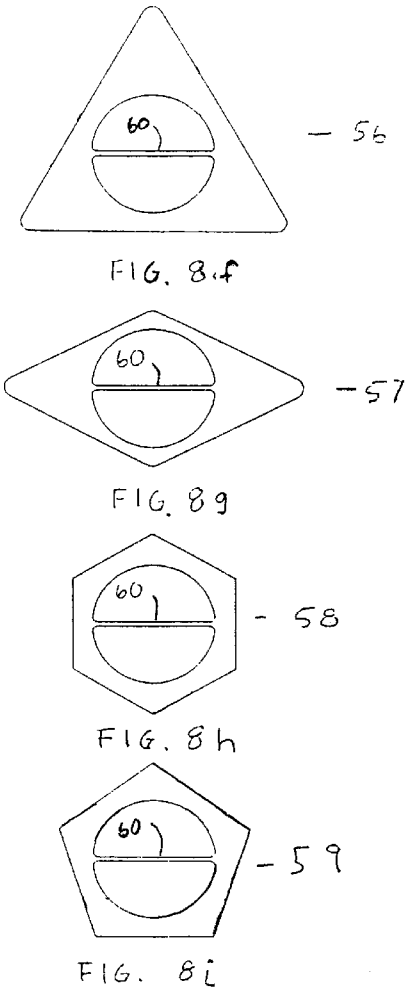

The present invention is directed to a device 2 (FIG. 4) capable of being attached to a roof as a component part of a snowguard system to prevent materials (e.g., snow) from falling off the roof. The device 2 includes, as shown in FIGS. 6A and 6B, a mounting bracket 8 having a mounting block 9 and a bracket portion 10 attached to the block and extending substantially perpendicularly from the upper surface thereof. FIGS. 7A and 7B, illustrate that bracket portion 10 may contain a plurality of bores 12 defining cutout regions. The stacked arrangement of bores allows the height of a pipe 20 (FIG. 5) to be adjusted relative to the roof surface over a wide range of predetermined positions. This allows the installer to adjust the height of the pipe to suit particular conditions with respect to snowfall or drifting. It is also possible to change the length of the flag to adjust the spacing thereof from the roof. In both cases, it is preferred that the bottom of the flag 22 is spaced from the roof by about ¼" to prevent damage to the roof from contact with the flag 22.

The mounting bracket 8 can be one integral piece, as shown in FIG. 6A, or can include separate pieces mated together, as shown in FIG. 7A. For example, mounting block 9 can include a first groove 16 (FIG. 4) in the upper surface thereof for slidably receiving bracket portion 10. Preferably, groove 16 in mounting block 9 has a cross-sectional shape like that of one-half of an I-beam, and mounting bracket 10 has a complementary shape at the bottom portion thereof as defined by slot 16a shown in FIG. 7A.

Mounting block 9 also can have a second groove 18 (FIG. 4) in the lower surface thereof for attachment to the seam of a metal roof. It should be recognized that the mounting bracket may be attached to the roof using any known attachment means. For example, one such attachment means is described in U.S. Pat. No. 5,613,328.

The profile of bracket portion 10 can take any shape; the shape illustrated in the drawings is only one example. For instance, the bracket could be rectangular, triangular or a rounded permutation thereof. If possible, the shape should make the bracket aesthetically pleasing when installed on the building.

As shown in FIGS. 6 and 7, the bracket portion 10 includes at least one bore 12 defining at least one cutout region 14 therethrough. This cut out region 14 receives pipe 20 (FIG. 5) therethrough. One purpose of cutout region 14 is to prevent rotation of the pipe 20 relative to bracket portion 10. To accomplish this objective, cutout region 14 can be shaped in a variety of ways. For instance, the perimeter of the cutout region 14 could be polygonal, parabolic, elliptical, truncated cone shaped or D-shaped. Regardless of the shape selected, the perimeter of cutout region 14 must be designed to prevent pipe 20 from rotating with respect to mounting bracket 8.

Figure 1:
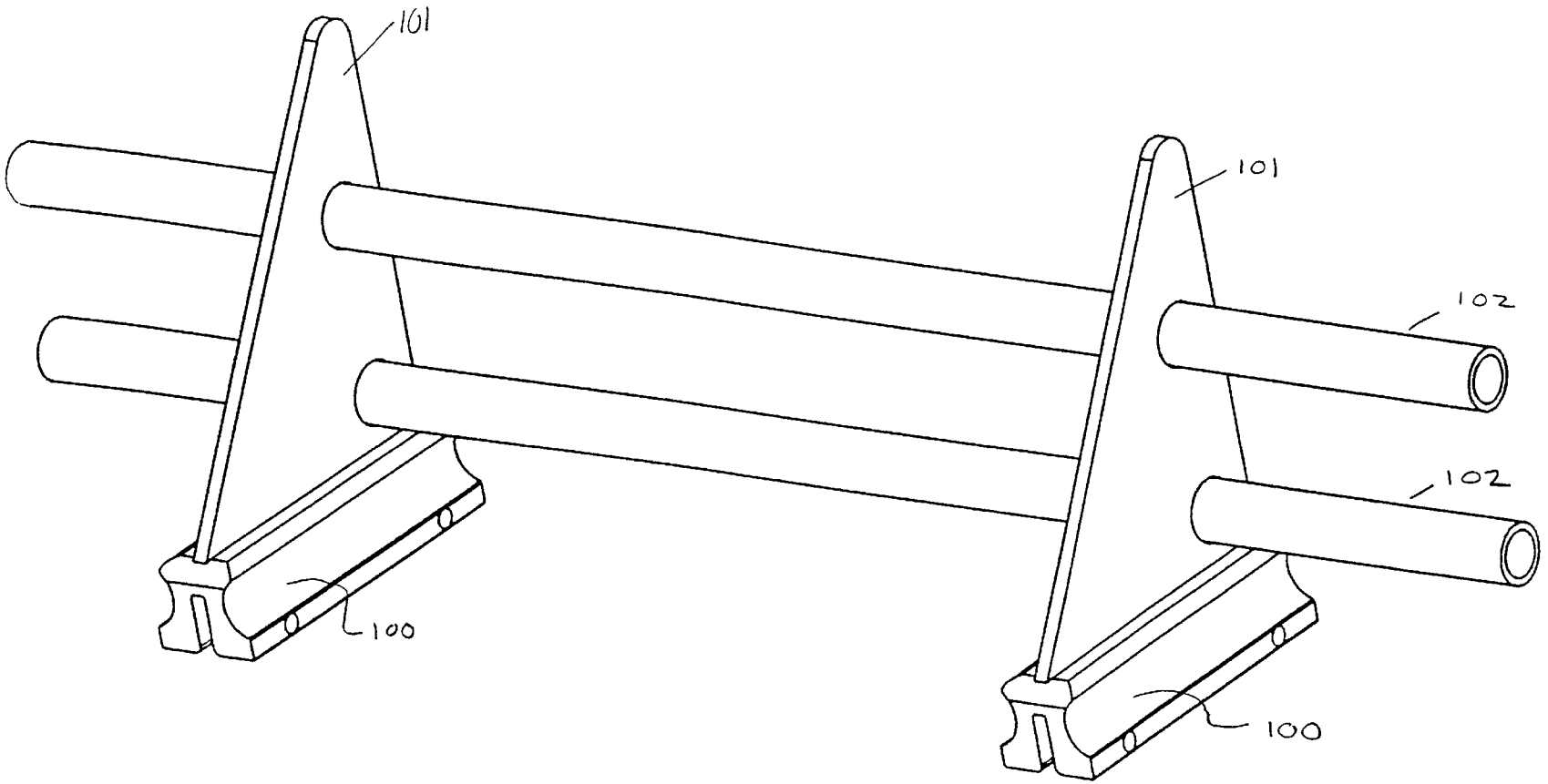
FIG. 1 is an orthogonal view of a prior art snow guard system (without flags) holding a snowload on the roof of a building.
Figure 2:
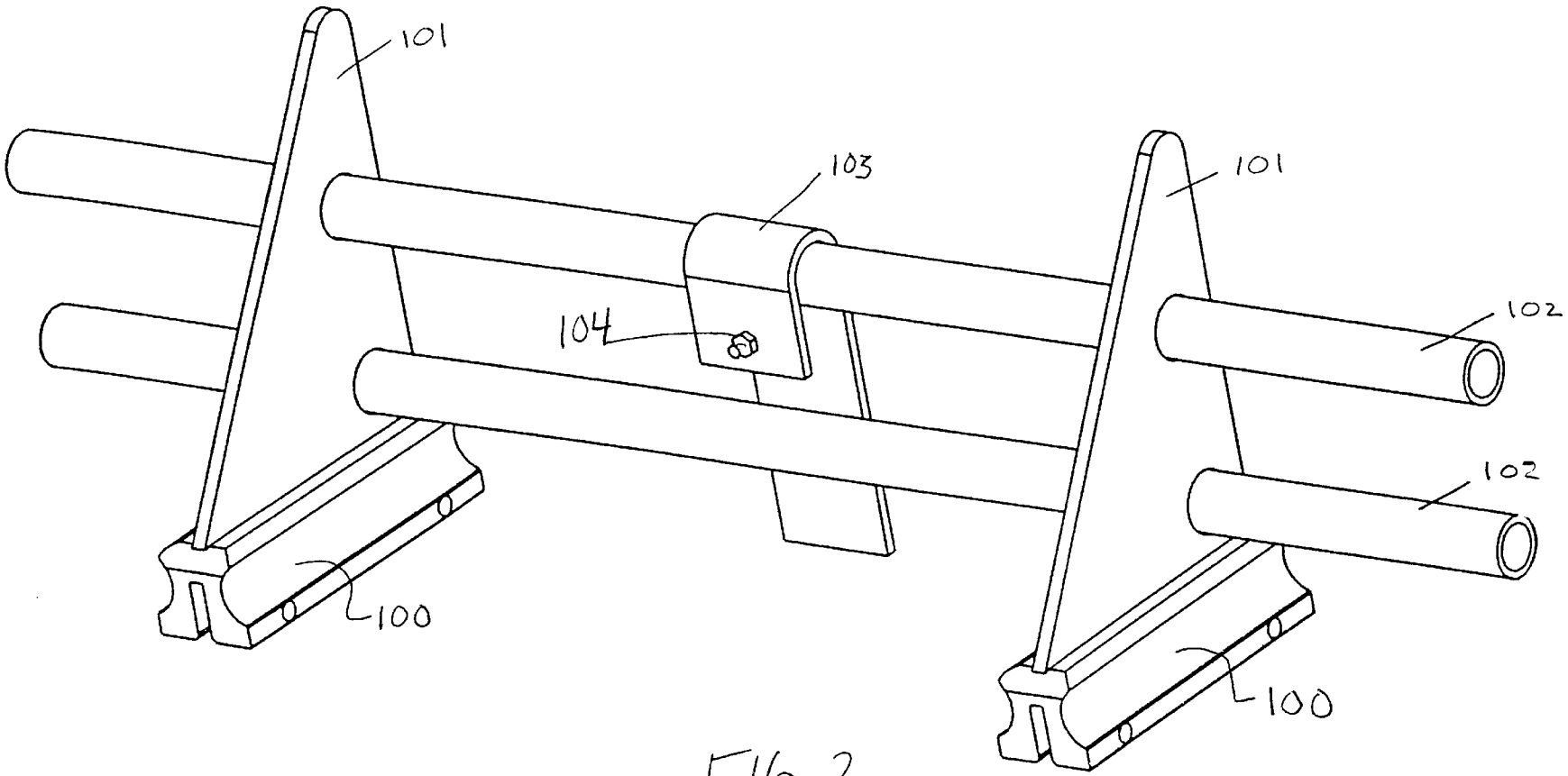
FIG. 2 shows a prior art flag attached to a pipe of a snowguard system.
Figure 3A:
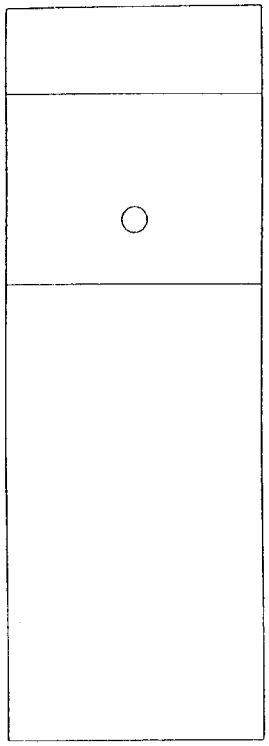
FIGS. 3A, 3B and 3C show frontal, side plan, and oblique views of a prior art flag, respectively.
Figure 3B:
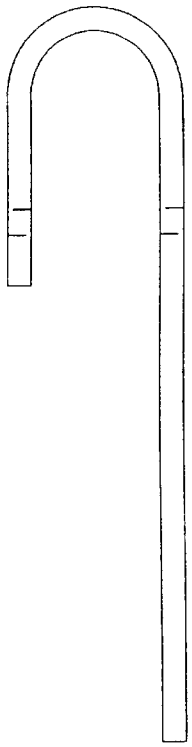
Figure 3C:
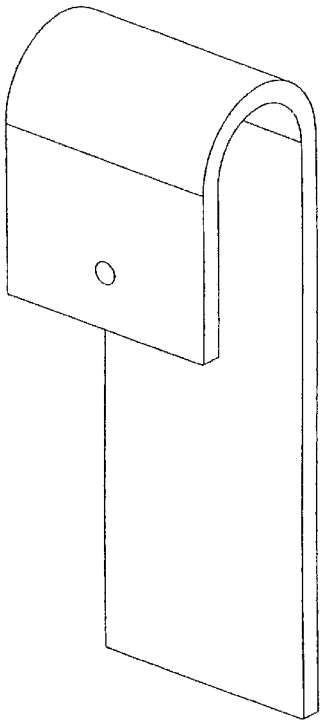
Figure 4:
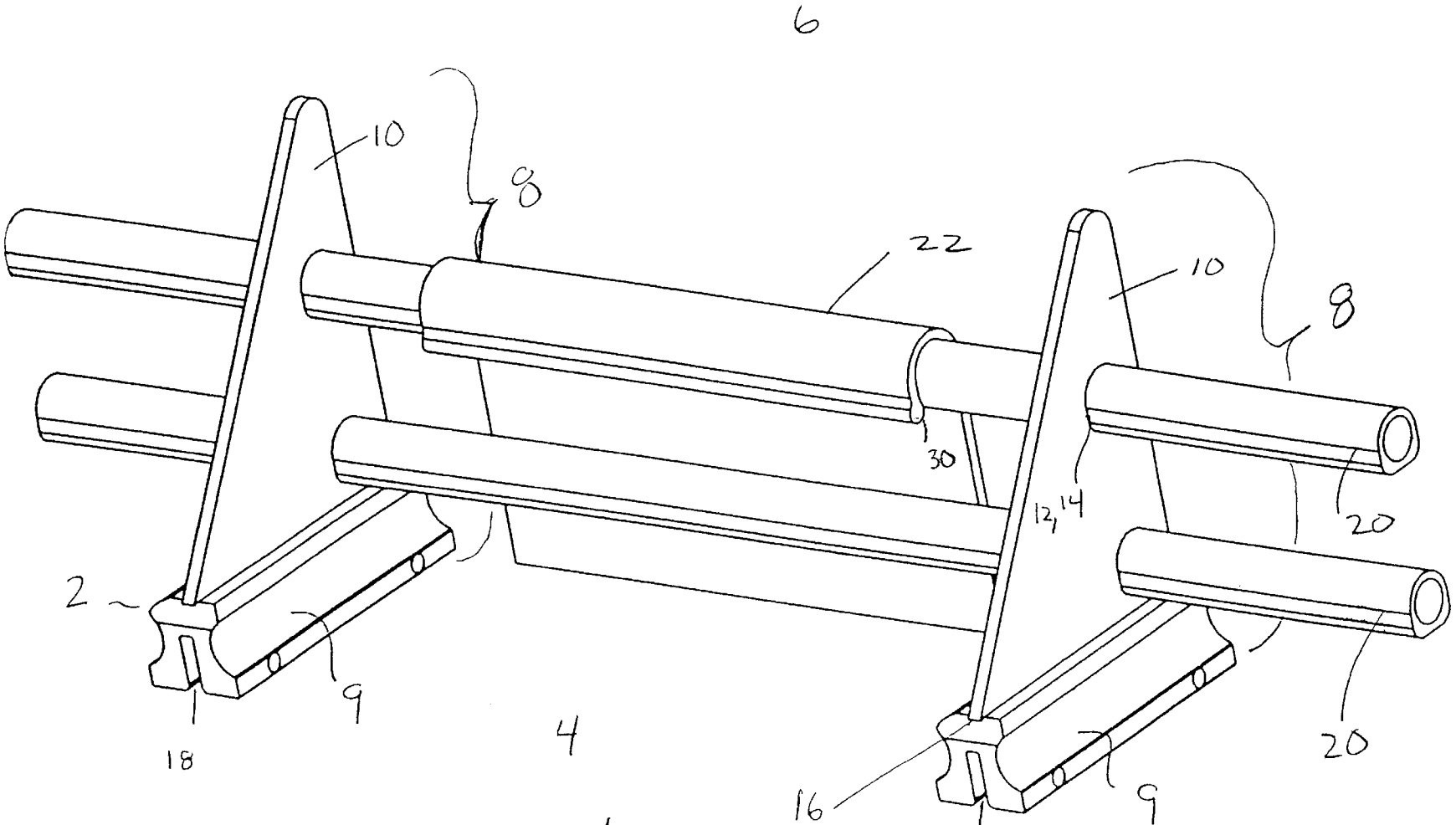
FIG. 4 is a partial perspective view of one embodiment of the present invention showing mounting bracket components and a flag component fastened to a portion of a pipe.
Figure 5:
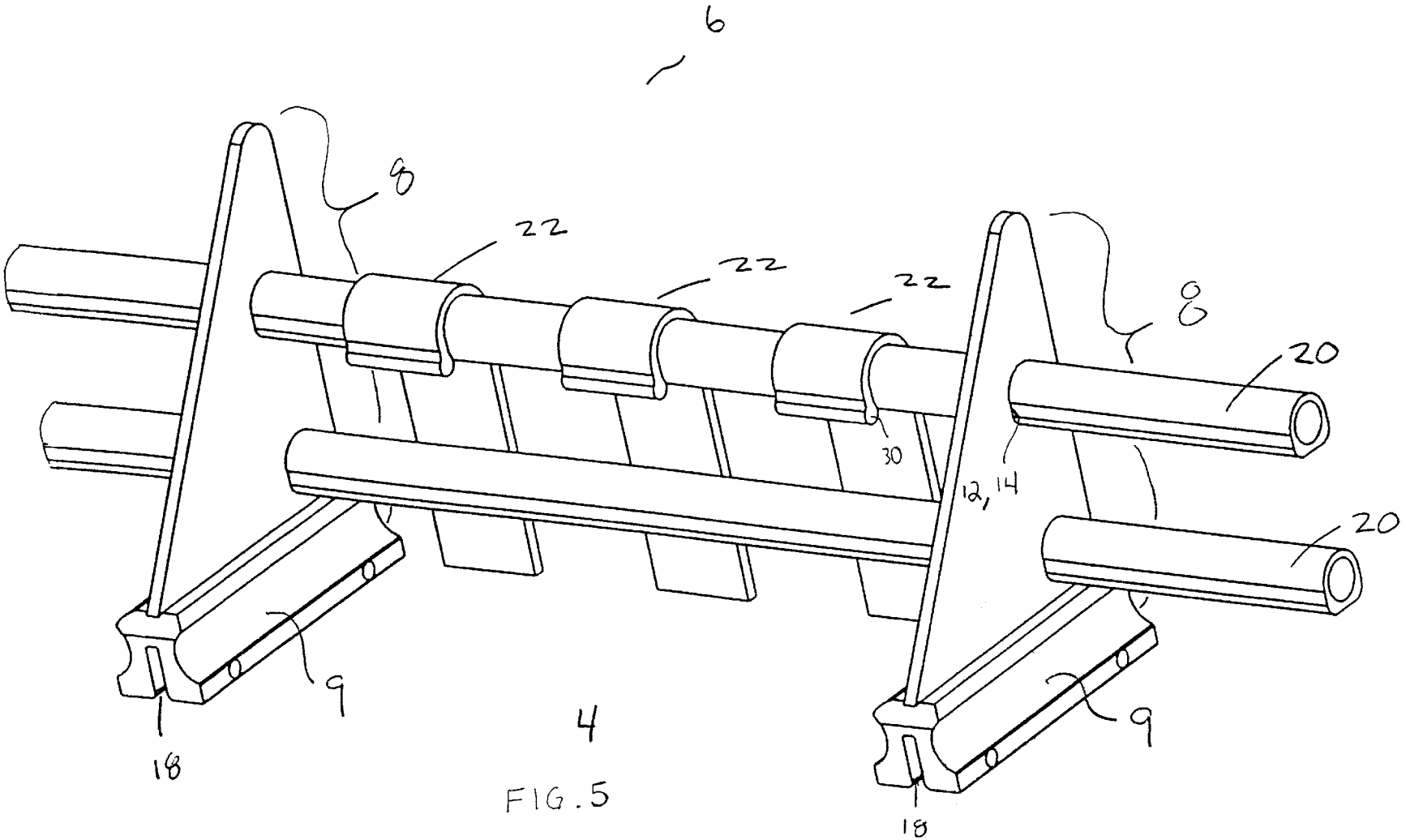
FIG. 5 is a perspective view of a snow guard system using a plurality of the flag components.

At least one pipe 20 is slidably insertable through bore 12, as shown in FIGS. 4 and 5. Pipe 20 has a circumferential shape substantially similar to that of the cutout region 14 to thereby prevent rotation of pipe 20 relative to bracket 8. The circumferential shape of pipe 20 should preferably be non-circular so that rotation thereof and, consequently, rotation of flag 22 is prevented. For instance, as illustrated in FIGS. 8*a*–8*i*, a D-shaped cross-section 51, a D-shaped cross-section with a hemispherical web 52, an elliptical-shaped cross-section 53, polygonal-shaped cross-sections 54, 55 and 57, a triangular-shaped cross-section 56, a hexagonal-shaped cross-section 58, and pentagonal-shaped cross-section could be employed. As shown in FIGS. 8*a*–8*i*, pipe may optionally include at least one diametrical reinforcement member 60 on its interior. This reinforcement member should be oriented to provide maximum resistance to the load exerted thereon (i.e., parallel to the direction of snow load). As shown in the preferred embodiment of FIG. 8B, the diametrical reinforcement member 60 is web-like in cross-section.

In practice of the invention, as shown in FIG. 5, bore 12 and pipe 20 should be oriented such that an axis of symmetry of pipe 20 is substantially perpendicular to the direction of the force exerted by a load thereon. This allows the pipe 20 to withstand maximum tensile and compressive stresses caused by the load.

Figure 9B:
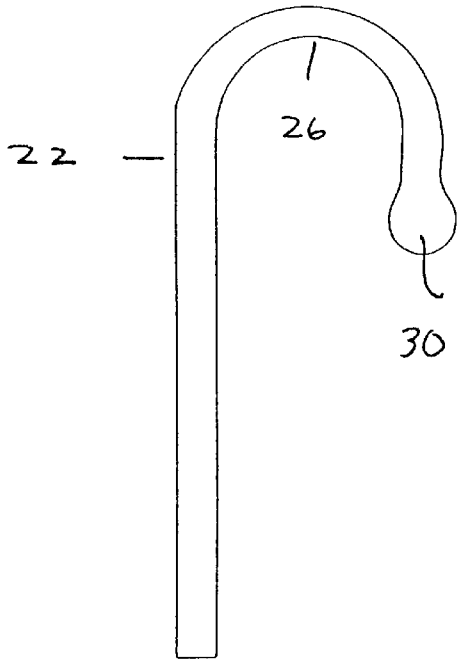
FIG. 9A, 9B and 9C show frontal, side plan and oblique views of a particular embodiment of the flag according to the present invention, respectively.
Figure 9A:
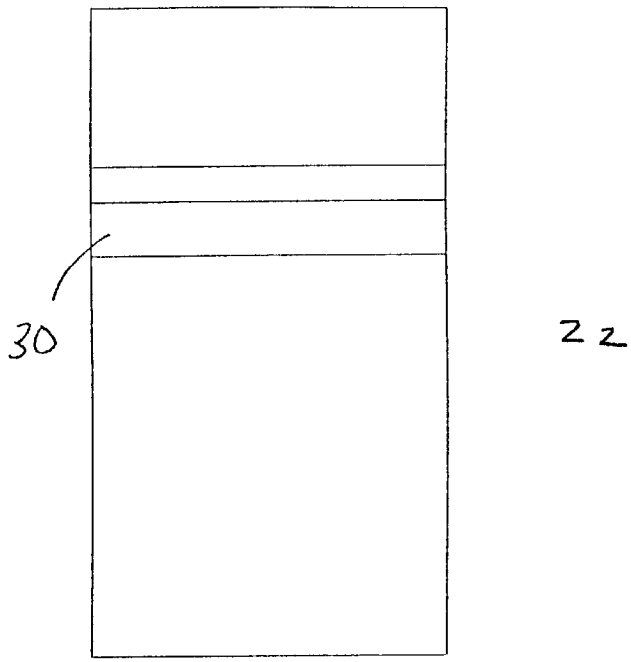
Figure 9C:
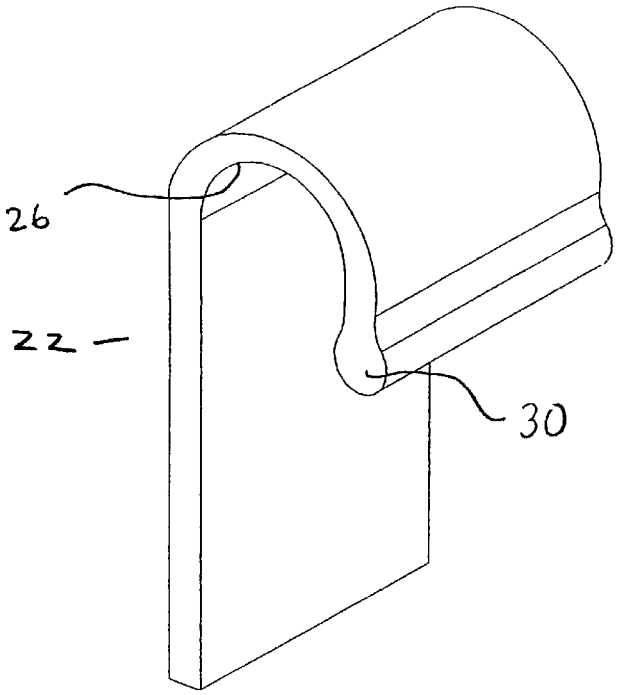

As shown in FIG. 4, the device 2 also includes at least one flag 22 locked to pipe 20. Flag 22 has an interior portion 26 (FIGS. 9*b* and 9*c*) whose shape is substantially geometrically similar to at least a portion of the circumferential shape of pipe 20. This allows the interior portion 26 of flag 22 to self-lockingly engage the exterior of pipe 20 to prevent rotation of flag 22 with respect to pipe 20. In the preferred embodiment shown in FIGS. 9*b* and 9*c*, the flag 22 has an inverted, vertical J-shape. However, any shape could be used, as long as it allows for attachment to the pipe 20 in a non-rotational manner.

The flag should be self-locking on pipe 20 without any additional attachment mechanism. The self-locking feature can be accomplished in a variety of ways depending upon the shape of interior portion 26 and the circumferential shape of pipe 20. In the preferred embodiment, a protrubance 30 is formed integrally with flag 22 to facilitate self-locking.

Each flag 22 is cut from a stock material. This allows the height and width to be custom designed for a particular roof. The width and height of flag 22 can be selected depending upon the intended snow-blocking effect. In dual pipe constructions as shown in FIG. 5, several narrow flags are used. By contrast, as shown in FIG. 4, the flag 22 employed is wider to reduce the number of flags between adjacent brackets 8. Similarly, as shown in FIG. 10, the height of the flag can be varied to allow for a predetermined clearance between the bottom of the flag 22 and the surface of the roof 4.

Figure 10:
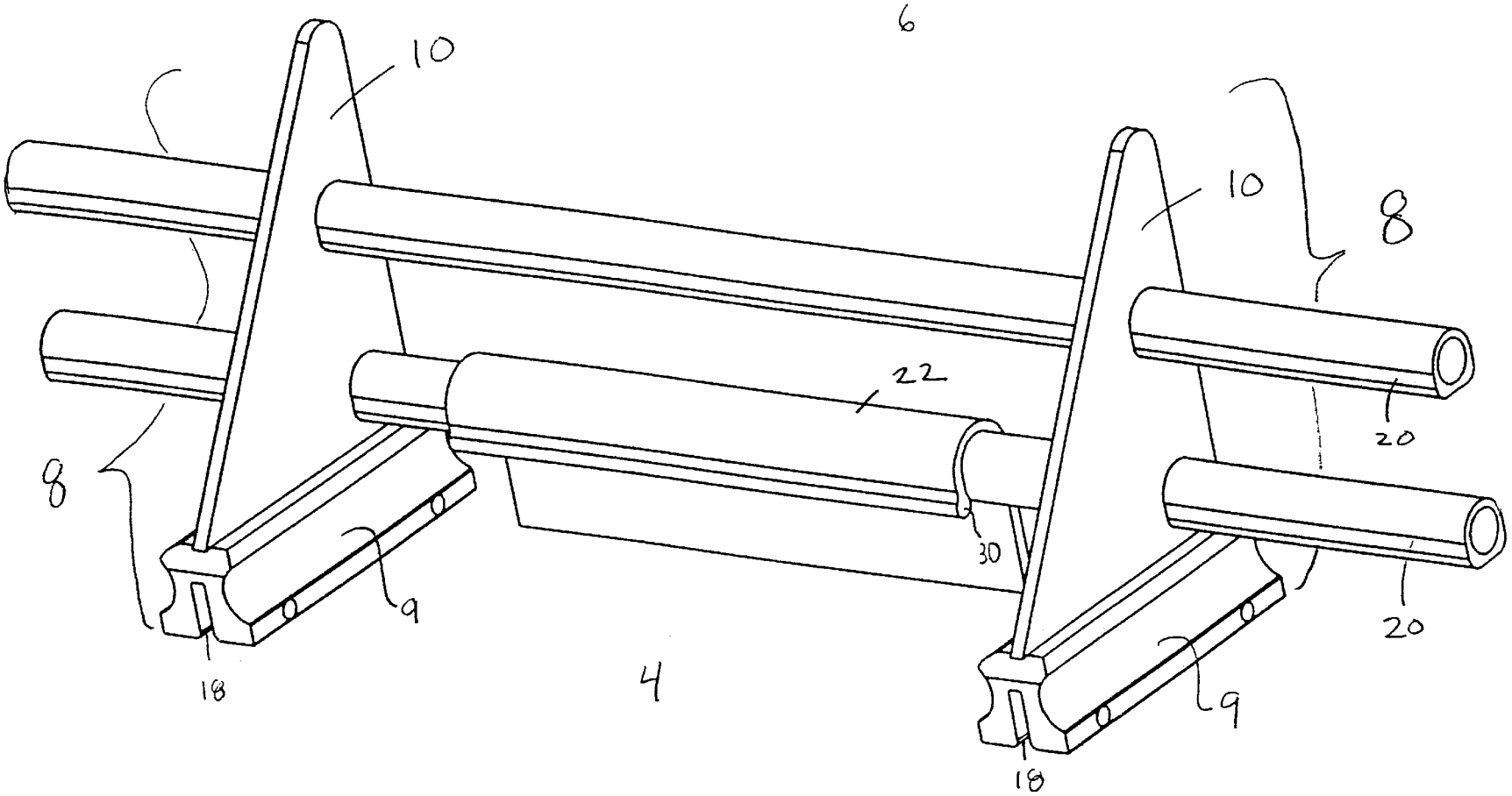
FIG. 10 is a side view of one embodiment of the present invention with one flag attached to a pipe.
Figure 11:
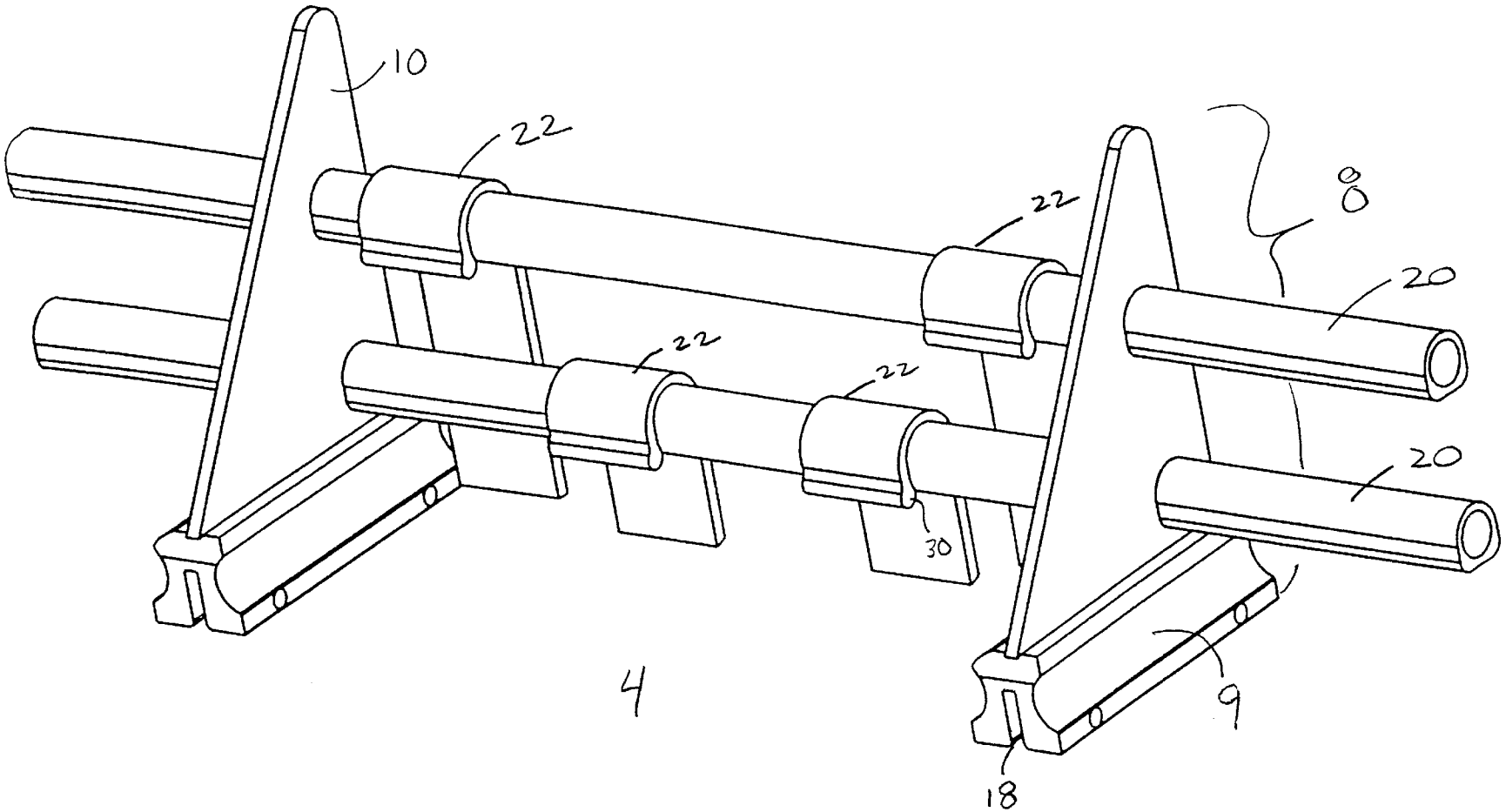
FIG. 11 is a side view of one embodiment of the present invention showing a plurality of flags attached to a plurality of pipes.

A plurality of the above-described mounting brackets 8 (i.e., mounting block 9 and bracket portion 10) are used to construct the snowguard system 6 shown in any of FIGS. 4, 5, 10 and 11. Each of the mounting brackets 8 are attached to the roof in a spaced fashion. At least one pipe 20 is then slidably inserted through one of the bores 12 in the respective bracket portions 10. As shown in FIG. 10, at least one flag 22 is then secured to pipe 20. In practice of the present invention, as shown in FIG. 11, a plurality of flags 22 could be attached to a plurality of pipes 20 as is necessary depending on the weather conditions. The interaction between the shapes of cutouts 12 and pipe 20 prevent rotation of pipe 20 relative to bracket 8. The interaction between the shapes of flag 22 and pipe 20 in turn prevents rotation of flag 22 relative to pipe 20 and bracket 8 while protuberance 30 assists in self-locking flag 22 on pipe 20, as it extends beyond the bottom of pipe 20.

The component parts of the snowguard system can be made of any known material. In the preferred embodiments discussed hereinabove, aluminum is the preferred material for the component parts (i.e., the blocks 9, brackets 10, pipes 20 and flags 22). However, any other known materials, (e.g., steel, stainless steel, high-impact plastic) may also be employed.

Although the snow guard device 2 described above is adaptable for use in a broad range of raised seam roofing applications, as explained earlier herein, the device 2 may also be readily adapted for use on shingled, slate or other non-raised seam roofs. In addition, the second groove 18 in the lower surface of the mounting bracket 8 may be adapted for use on raised seam roofs having any known particular panel width or seam profile. The device 2 can also either be permanently attached to a roof or designed so that the device can be removed easily for repositioning as desired.

As can be seen from the above disclosure, the snowguard system of the present invention prevents avalanching of snow since the snow is blocked as it begins to slide. The flag 22 further enhances the ability of the system to restrain the snow on the roof. Without this flag 22 in place between pipe 20 and roof 4, the snow would simply slide under pipe 22 and off roof 4. The improved flag 22, bracket portion 10, and pipe 20 assembly described herein help assure that flag 22 will remain in its intended position by preventing any rotation of both flag 22 and pipe 20. This ensures that flag 22 does not fall off or rotate out of position.

Advantageously, flag 22 is easily assembled on pipe 20 as it simply clips onto pipe 20. Moreover, since flag 22 is locked in place, the need for more than one pipe is eliminated since a second pipe 20 is no longer necessary to prevent rotation (in one direction only) of flag 22.

The assembly described above is less expensive to manufacture and easier to install compared to prior art snow guard systems. This is because the flags can be secured to the pipes in a self-locking manner that also prevents rotation of the flags. The assembly does not require supplemental securing means for the flags (although such could be employed) and allows for elimination of one of the two pipes used in traditional systems.

While the present invention has been particularly shown and described with reference to the preferred mode as illustrated in the drawings, it will be understood by one skilled in the art that various changes in detail may be effected therein without departing from the spirit and scope of the invention as defined by the claims.

I claim:

1. A device for use as a component part of a snowguard system for preventing materials from sliding off a roof, comprising:

a mounting bracket having a bracket portion with at least one bore defining at least one cutout region therethrough, said cutout region having a non-circular cross-sectional shape;

at least one non-cylindrical member slidably insertable through said bore, said non-cylindrical member having a cross-sectional shape substantially similar to that of said cutout region to thereby prevent rotation of said non-cylindrical member relative to said bracket; and at least one flag having an interior portion whose shape is substantially geometrically similar to at least a portion of said cross-sectional shape of said non-cylindrical member, thereby allowing the interior portion of said flag to lockingly engage the exterior of said non-cylindrical member to prevent rotation of the flag with respect to said non-cylindrical member, wherein when said device is mounted on a roof, said at least one flag impedes snow and/or ice from sliding off of said roof.

2. The device of claim 1, wherein said mounting bracket comprises a mounting block and a bracket portion, wherein said mounting block has a first groove in the upper surface thereof for slidably receiving said bracket portion, and wherein said mounting block has a second groove in the lower surface thereof for attachment to the seam of a metal roof.

3. The device of claim 1, wherein the cross-sectional shape of said non-cylindrical member is non-circular.

4. The device of claim 1, wherein said non-cylindrical member has a D-shaped cross-section.

5. The device of claim 1, wherein said flag has an inverted J-shape.

6. The device of claim 1, wherein said bore and said non-cylindrical member are oriented such that an axis of symmetry of said non-cylindrical member is substantially perpendicular to a direction of a force exerted by a load thereon, thereby allowing said non-cylindrical member to withstand maximum tensile and compressive stresses caused by the load.

7. The device of claim 1, wherein said non-cylindrical member includes at least one diametrical reinforcement member on its interior oriented to provide maximum resistance to the load exerted thereon.

8. The device of claim 7, wherein said diametrical reinforcement member comprises at least four radial web members which extend longitudinally within said non-cylindrical member.

9. The device of claim 1, wherein a surface of said flag which is substantially parallel to an axis of said non-cylindrical member is substantially larger than surfaces of said flag which are not substantially parallel to said axis of said non-cylindrical member.

10. The device of claim 1, wherein said mounting bracket comprises means for engaging with a roof.

11. A snowguard system for preventing materials from sliding off a roof, comprising:

a plurality of mounting brackets each having a bracket portion with at least one bore defining at least one cutout region therethrough, said cutout region having a non-circular cross-sectional shape;

at least one non-cylindrical member slidably insertable through one of said bores in each of said bracket portions, each said non-cylindrical member having a cross-sectional shape substantially similar to that of each cutout region to thereby prevent rotation of said non-cylindrical member with respect to said bracket; and at least one flag for attachment to said non-cylindrical member, each flag having an interior portion whose shape is substantially geometrically similar to at least a portion of said cross-sectional shape of said non-cylindrical member, thereby allowing said interior portion of said flag to lockingly engage the exterior of a said non-cylindrical member such that said flag does not rotate with respect to said non-cylindrical member to which it is attached, wherein when said device is mounted on a roof, said at least one flag impedes snow and/or ice from sliding off of said roof.

12. The device of claim 11, wherein said mounting bracket comprises a mounting block and a bracket portion, wherein said mounting block has a first groove in the upper surface thereof for slidably receiving said bracket portion, and wherein said mounting block has a second groove in the lower surface thereof for attachment to the seam of a metal roof.

13. The device of claim 11, wherein the cross-sectional shape of said non-cylindrical member is non-circular.

14. The device of claim 11, wherein said non-cylindrical member is D-shaped in cross section.

15. The device of claim 11, wherein said flag has an inverted J-shape.

16. The device of claim 11, wherein said bore and said non-cylindrical member are oriented such that an axis of symmetry of said non-cylindrical member is substantially perpendicular to a direction of a force exerted by a load thereon, thereby allowing said non-cylindrical member to withstand maximum tensile and compressive stresses caused by the load.

17. The device of claim 11, wherein said non-cylindrical member includes at least one diametrical reinforcement member on its interior oriented to provide maximum resistance to the load exerted thereon.

18. The device of claim 17, wherein said diametrical reinforcement member comprises at least four radial web members which extend longitudinally within said non-cylindrical member.

19. The device of claim 11, wherein a surface of said flag which is substantially parallel to an axis of said non-cylindrical member is substantially larger than surfaces of said flag which are not substantially parallel to said axis of said non-cylindrical member.

20. The device of claim 11, wherein said mounting bracket comprises means for engaging with a roof.

21. A device for use as a component part of a snowguard system for preventing materials from sliding off a roof, comprising:

a mounting bracket having a bracket portion with at least one bore defining at least one cutout region therethrough, said cutout region having a non-circular cross-sectional shape;

at least one non-cylindrical member slidably insertable through said bore, said non-cylindrical member having a cross-sectional shape substantially similar to that of said cutout region to thereby prevent rotation of said non-cylindrical member relative to said bracket; and at least one flag having an interior portion whose shape is substantially geometrically similar to at least a portion of said cross-sectional shape of said non-cylindrical member, thereby allowing the interior portion of said flag to lockingly engage the exterior of said non-cylindrical member to prevent rotation of the flag with respect to said non-cylindrical member, said flag being self-locking on said non-cylindrical member without an additional attachment mechanism.

22. The device of claim 21, wherein said mounting bracket comprises a mounting block and a bracket portion, wherein said mounting block has a first groove in the upper surface thereof for slidably receiving said bracket portion, and wherein said mounting block has a second groove in the lower surface thereof for attachment to the seam of a metal roof.

23. The device of claim 21, wherein said non-cylindrical member has a D-shaped cross-section.

24. The device of claim 21, wherein said flag has an inverted J-shape.

25. The device of claim 21, wherein said bore and said non-cylindrical member are oriented such that an axis of symmetry of said non-cylindrical member is substantially perpendicular to the direction of the force exerted by a load thereon, thereby allowing said non-cylindrical member to withstand maximum tensile and compressive stresses caused by the load.

26. The device of claim 21, wherein said non-cylindrical member includes at least one diametrical reinforcement member on its interior oriented to provide maximum resistance to the load exerted thereon.

27. The device of claim 21, wherein said flag has a major surface which is substantially parallel to an axis of said non-cylindrical member.

28. The device of claim 21, wherein said mounting bracket comprises means for engaging with a roof.

29. The device of claim 21, wherein said device is attached to said roof.

30. A snowguard system for preventing materials from sliding off a roof, comprising:

a plurality of mounting brackets each having a bracket portion with at least one bore defining at least one cutout region therethrough, said cutout region having a non-circular cross-sectional shape;

at least one non-cylindrical member slidably insertable through one of said bores in each of said bracket portions, each said non-cylindrical member having a cross-sectional shape substantially similar to that of each cutout region to thereby prevent rotation of said non-cylindrical member with respect to said bracket; and at least one flag for attachment to said non-cylindrical member, said flag having an interior portion whose shape is substantially geometrically similar to at least a portion of said cross-sectional shape of said non-cylindrical member, thereby allowing said interior portion of said flag to lockingly engage the exterior of a said non-cylindrical member such that said flag does not rotate with respect to said non-cylindrical member to which it is attached, said flag being self-locking on said non-cylindrical member without an additional attachment mechanism.

31. The device of claim 30, wherein said mounting bracket comprises a mounting block and a bracket portion, wherein said mounting block has a first groove in the upper surface thereof for slidably receiving said bracket portion, and wherein said mounting block has a second groove in the lower surface thereof for attachment to the seam of a metal roof.

32. The device of claim 30, wherein said non-cylindrical member has a D-shaped cross-section.

33. The device of claim 30, wherein said flag has an inverted J-shape.

34. The device of claim 30, wherein said bore and said non-cylindrical member are oriented such that an axis of symmetry of said non-cylindrical member is substantially perpendicular to the direction of the force exerted by a load thereon, thereby allowing said non-cylindrical member to withstand maximum tensile and compressive stresses caused by the load.

35. The device of claim 30, wherein said non-cylindrical member includes at least one diametrical reinforcement member on its interior oriented to provide maximum resistance to the load exerted thereon.

36. The device of claim 30, wherein said flag has a major surface which is substantially parallel to an axis of said non-cylindrical member.

37. The device of claim 30, wherein said mounting bracket comprises means for engaging with a roof.

38. The device of claim 30, wherein said device is attached to said roof.

39. A device for use as a component part of a snowguard system for preventing materials from sliding off a roof, comprising:

a mounting bracket having a bracket portion with at least one bore defining at least one cutout region therethrough, said cutout region having a non-circular cross-sectional shape;

at least one non-cylindrical member slidably insertable through said bore, said non-cylindrical member having a cross-sectional shape substantially similar to that of said cutout region to thereby prevent rotation of said non-cylindrical member relative to said bracket; and at least one flag having an interior portion whose shape is substantially geometrically similar to at least a portion of said cross-sectional shape of said non-cylindrical member, thereby allowing the interior portion of said flag to lockingly engage the exterior of said non-cylindrical member to prevent rotation of the flag with respect to said non-cylindrical member, said device being attached to said roof.

40. The device of claim 39, wherein said mounting bracket comprises a mounting block and a bracket portion, wherein said mounting block has a first groove in the upper surface thereof for slidably receiving said bracket portion, and wherein said mounting block has a second groove in the lower surface thereof for attachment to the seam of a metal roof.

41. The device of claim 39, wherein said non-cylindrical member has a D-shaped cross-section.

42. The device of claim 39, wherein said flag has an inverted J-shape.

43. The device of claim 39, wherein said bore and said non-cylindrical member are oriented such that an axis of symmetry of said non-cylindrical member is substantially perpendicular to the direction of the force exerted by a load thereon, thereby allowing said non-cylindrical member to withstand maximum tensile and compressive stresses caused by the load.

44. The device of claim 39, wherein said non-cylindrical member includes at least one diametrical reinforcement member on its interior oriented to provide maximum resistance to the load exerted thereon.

45. The device of claim 39, wherein said flag has a major surface which is substantially parallel to an axis of said non-cylindrical member.

46. The device of claim 39, wherein said mounting bracket comprises means for engaging with said roof.

47. A snowguard system for preventing materials from sliding off a roof, comprising:

a plurality of mounting brackets each having a bracket portion with at least one bore defining at least one cutout region therethrough, said cutout region having a non-circular cross-sectional shape;

at least one non-cylindrical member slidably insertable through one of said bores in each of said bracket portions, each said non-cylindrical member having a cross-sectional shape substantially similar to that of each cutout region to thereby prevent rotation of said non-cylindrical member with respect to said bracket; and at least one flag for attachment to said non-cylindrical member, each flag having an interior portion whose shape is substantially geometrically similar to at least a portion of said cross-sectional shape of said non-cylindrical member, thereby allowing said interior portion of said flag to lockingly engage the exterior of a said non-cylindrical member such that said flag does not rotate with respect to said non-cylindrical member to which it is attached, said device being attached to said roof.

48. The device of claim 47, wherein said mounting bracket comprises a mounting block and a bracket portion, wherein said mounting block has a first groove in the upper surface thereof for slidably receiving said bracket portion, and wherein said mounting block has a second groove in the lower surface thereof for attachment to the seam of a metal roof.

49. The device of claim 49, wherein said non-cylindrical member has a D-shaped cross-section.

50. The device of claim 49, wherein said flag has an inverted J-shape.

51. The device of claim 49, wherein said bore and said non-cylindrical member are oriented such that an axis of symmetry of said non-cylindrical member is substantially perpendicular to the direction of the force exerted by a load thereon, thereby allowing said non-cylindrical member to withstand maximum tensile and compressive stresses caused by the load.

52. The device of claim 47, wherein said non-cylindrical member includes at least one diametrical reinforcement member on its interior oriented to provide maximum resistance to the load exerted thereon.

53. The device of claim 47, wherein said flag has a major surface which is substantially parallel to an axis of said non-cylindrical member.

54. The device of claim 47, wherein said mounting bracket comprises means for engaging with said roof.

* * * * *